US005558964A

United States Patent [19]

Yoshihara et al.

[11] Patent Number: 5,558,964

[45] Date of Patent: Sep. 24, 1996

[54] ELECTROPHOTOGRAPHIC PHOTOSENSITIVE MEMBER, AND ELECTROPHOTOGRAPHIC APPARATUS, DEVICE UNIT, AND FACSIMILE MACHINE EMPLOYING THE SAME

[75] Inventors: Toshiyuki Yoshihara, Tokyo; Nobuyuki Hanami, Matsudo; Hideyuki Takai, Yokohama; Hideki Anayama, Yokohama; Hajime Miyazaki, Yokohama; Junichi Kishi, Tokyo; Itaru Yamazaki, Yokohama; Harumi Sakoh, Kawasaki; Tetsuro Kanemaru, Tokyo; Kazushi Iuchi, Ebetsu; Hideyuki Ainoya, Tokyo, all of Japan

[73] Assignee: Canon Kabushiki Kaisha, Tokyo, Japan

[21] Appl. No.: 354,441

[22] Filed: Dec. 12, 1994

Related U.S. Application Data

[63] Continuation of Ser. No. 964,950, Oct. 22, 1992, abandoned.

[30] Foreign Application Priority Data

Oct. 25, 1991 [JP] Japan ..... 3-305707

[51] Int. Cl.[6] ..... G03G 15/02

[52] U.S. Cl. ..... 430/58; 430/57; 430/72; 430/75; 355/271; 355/296

[58] Field of Search ..... 430/58, 57, 72, 430/75; 355/271, 296

[56] References Cited

U.S. PATENT DOCUMENTS

| | | | |
|---|---|---|---|
| 3,729,312 | 4/1973 | Young, Jr. | 16/1.5 |
| 4,444,481 | 4/1984 | Mizokami | 354/401 |
| 4,664,997 | 5/1987 | Suzuki et al. | 430/58 |
| 4,717,636 | 1/1988 | Takahashi et al. | 430/58 |
| 4,728,592 | 3/1988 | Ohaku et al. | 430/59 |
| 5,132,197 | 7/1992 | Iuchi et al. | 430/76 |

FOREIGN PATENT DOCUMENTS

| | | |
|---|---|---|
| 314100 | 5/1989 | European Pat. Off. . |
| 409737 | 1/1991 | European Pat. Off. . |
| 405420 | 1/1991 | European Pat. Off. . |
| 433172 | 6/1991 | European Pat. Off. . |
| 492618 | 7/1992 | European Pat. Off. . |
| 498448 | 8/1992 | European Pat. Off. . |
| 2580830 | 10/1980 | France . |
| 59-49544 | 3/1984 | Japan . |
| 59-166959 | 9/1984 | Japan . |
| 61-239248 | 10/1986 | Japan . |
| 62-67094 | 3/1987 | Japan . |
| 63-366 | 1/1988 | Japan . |
| 63-161158 | 7/1988 | Japan . |
| 63-198067 | 8/1988 | Japan . |
| 64-17066 | 1/1989 | Japan . |

OTHER PUBLICATIONS

Derwent Publications Ltd, Section Ch, Week 1590, Class A10, AN90–111854 (15)—Abst. JPA 2–062533.

*Primary Examiner*—Mark Chapman

*Attorney, Agent, or Firm*—Fitzpatrick, Cella, Harper & Scinto

[57] ABSTRACT

An to an electrophotographic photosensitive member includes a photosensitive layer containing a specified oxytitanium phthalocyanine and a polyvinyl acetal resin having a structural unit represented by Formula:

wherein X is a hydrogen atom, a fluorine atom, a chlorine atom, a bromine atom, a nitro group, or a cyano group; and Y is a fluorine atom, a chlorine atom, a bromine atom, a nitro group, or a cyano group. The photosensitive member maintains a low residual potential without deterioration of the sensitivity during repeated use.

14 Claims, 1 Drawing Sheet

ELECTROPHOTOGRAPHIC PHOTOSENSITIVE MEMBER, AND ELECTROPHOTOGRAPHIC APPARATUS, DEVICE UNIT, AND FACSIMILE MACHINE EMPLOYING THE SAME

This application is a continuation of application Ser. No. 07/964,950 filed Oct. 22, 1992, now abandoned.

BACKGROUND OF THE INVENTION

1. Field of the Invention

The present invention relates to an electrophotographic photosensitive member. More particularly, the present invention relates to an electrophotographic photosensitive member containing a specific compound and a specific resin. The present invention further relates to an electrophotographic apparatus, a device unit, and a facsimile machine employing the above electrophotographic photosensitive member.

2. Related Background Art

In recent years, electrophotographic photosensitive members utilizing an organic material have come to be widely employed in copying machines and printers, and active research and development of the organic materials are going on.

Among the materials, especially oxytitanium phthalocyanines are attracting attention. Oxytitanium phthalocyanine is highly useful as a photosensitive material for electrophotographic printers and digital copying machines utilizing LED or semiconductor laser as the light source, since the oxytitanium phthalocyanine is highly sensitive to having a light wavelength ranging from about 600 nm to about 800 nm.

The electrophotographic photosensitive member employing oxytitanium phthalocyanine, however, has a disadvantage in spite of its high sensitivity, which is the relatively high residual potential under certain operating conditions. For example, when oxytitanium phthalocyanine is used in combination with a charge-transporting material, the ionization potential of the oxytitanium phthalocyanine is lower than that of conventional charge-transporting material. This is one reason why the carrier injection is not sufficient in the region of low electric field strength, and thereby the residual potential becomes high. An electrophotographic photosensitive member having such characteristics tends to give insufficient potential contrast in a electrophotographic system at a high processing speed or at a short process cycle, or in a system of laser beam exposure with a small laser spot. Furthermore, in such an electrophotographic photosensitive member, latitude for design of components is inevitably smaller as to the constitutions other than of oxytitanium phthalocyanine, such as in a charge-transporting layer, an intermediate layer, and surface-protection layer.

With the recent demand for high quality images and high durability of photosensitive members, electrophotographic photosensitive members being studied for higher sensitivity and better electrophotographic characteristics in repeated use.

SUMMARY OF THE INVENTION

The present invention provides an electrophotographic photosensitive member having high sensitivity, exhibiting low residual potential, and having high running durability.

The present invention also provides an electrophotographic apparatus, a device unit, and a facsimile machine which employ the electrophotographic photosensitive member.

The present invention provides an electrophotographic photosensitive member comprising an electroconductive support, and a photosensitive layer formed thereon, the photosensitive layer containing oxytitanium phthalocyanine and a polyvinyl acetal resin having a structural unit represented by Formula (1) below:

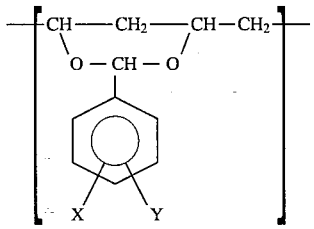

(1)

wherein X is a hydrogen atom, a fluorine atom, a chlorine atom, a bromine atom, a nitro group, or a cyano group; and Y is a fluorine atom, a chlorine atom, a bromine atom, a nitro group, or a cyano group.

The present invention also provides an electrophotographic apparatus, a device unit, and a facsimile machine which employ the above-specified electrophotographic photosensitive member.

DESCRIPTION OF THE PREFERRED EMBODIMENT

Figure 1:
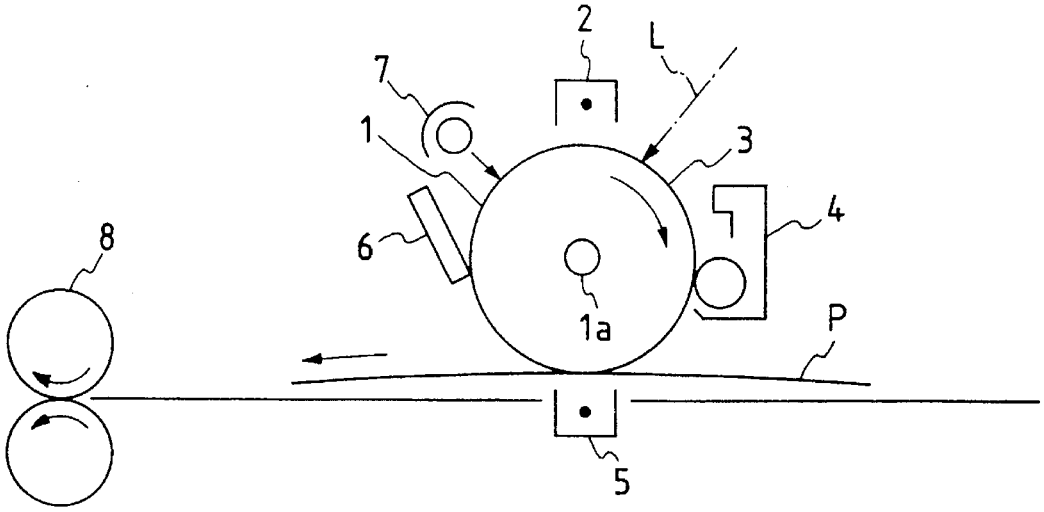
FIG. 1 schematically shows a constitution of an electrophotographic apparatus employing an electrophotographic photosensitive member of the present invention.

The electrophotographic photosensitive member of the present invention has a photosensitive layer which contains oxytitanium phthalocyanine and a polyvinyl acetal resin having the structural unit represented by Formula (1) below:

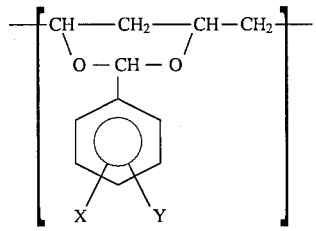

(1)

wherein X is a hydrogen atom, a fluorine atom, a chlorine atom, a bromine atom, a nitro group, or a cyano group; and Y is a fluorine atom, a chlorine atom, a bromine atom, a nitro group, or a cyano group.

The oxytitanium phthalocyanine used in the present invention has the structure as below:

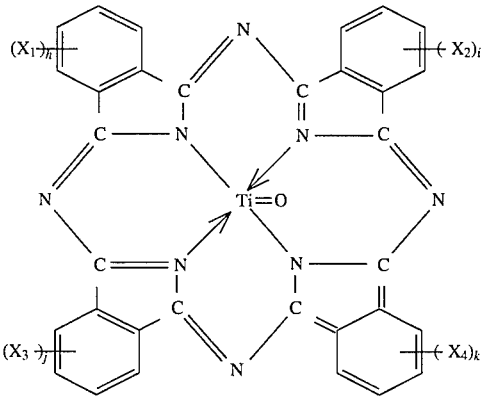

wherein $X_1$, $X_2$, $X_3$, and $X_4$ are independently Cl or Br; and h, i, j, and k are independently a number of 0 to 4.

Oxytitanium phthalocyanine takes various crystal forms like other phthalocyanines. Various crystal forms of oxytitanium phthalocyanine, production methods thereof, and electrophotographic characteristics thereof are described in JP-A-59-49544 (corresponding to U.S. Pat. No. 4,444,861) (herein after term "JP-A" refers to "Japanese Laid-Open Patent Application No."), JP-A-59-166959, JP-A-61-239248 (U.S. Pat. No. 4,728,592), JP-A-62-67094 (U.S. Pat. No. 4,664,997), JP-A-63- 366, JP-A-63-116158, JP-A-63-198067, and JP-A-64-17066, and so forth. Among them, the one exhibiting strong peaks at Bragg angles (2 θ±0.2°) of 9.0°, 14.2°, 23.9°, and 27.1° in CuKα X-ray diffraction characteristics is particularly preferred since it is highly sensitive and is capable of promoting the effect of the present invention.

On studying the binder resin to bind the oxytitanium phthalocyanine, the inventors of the present invention found that an electrophotographic photosensitive member employing oxytitanium phthalocyanine and a resin having a specified structure maintains a low steady residual potential and improved potential characteristics without deterioration of the sensitivity during repeated use.

Commercially available polyvinyl acetal resins are polyvinyl butyral resins produced from butyl aldehyde and polyvinyl alcohol. While, the polyvinyl acetal resin of the present invention has substituted aryl groups in place of the butyl groups of commercial polyvinyl butyral resins, and the substituent for the aryl group is electron-attracting. It is believed that the use of such a binder resin raises the ionization potential and electron transporting ability of the layer containing the charge-generating oxytitanium phthalocyanine, thereby giving the effect of lowering the residual potential.

The polyvinyl acetal resin used in the present invention can be obtained by reacting polyvinyl alcohol and a substituted aryl aldehyde in a similar manner as for conventional polyvinyl butyral resin sinthesis, for example, reaction in a mixed solvent of methanol and benzene in the presence of an acid such as hydrochloric acid and sulfuric acid.

The polyvinyl acetal resin used in the present invention has preferably a weight-average molecular weight of from 10,000 to 500,000, and more preferably from 30,000 to 100,000. When the molecular weight is lower than 10,000, the dispersion of a pigment and the film forming property tend to be insufficient. If the molecular weight is higher than 500,000, handling of the materials during resin synthesis tends to be troublesome and to cause unsatisfactory dispersion of pigment due to its high viscosity during dispersion treatment.

The polyvinyl acetal resin used in the present invention is preferably acetalized to an acetalization degree of 50 mol% or higher, more preferably from 65 to 85 mol%. When the acetalization degree is lower than 50 mol%, the poor solubility of the resin in a solvent will reduce the number of the substituting aryl group, and thus the effect of the present invention will be insufficient. On the other hand, a resin of acetalization degree of higher than 85 mol% is difficult to synthesize, or cannot be obtained.

In the present invention, a lower content of residual vinyl acetate is more effective for the present invention, where the residual vinyl acetate comes from the starting polyvinyl alcohol. As the starting material, polyvinyl alcohol of saponification degree of 85% or higher is preferred. When the saponification degree is lower than 85%, the acetalization degree tends to be low.

Further, in the present invention the polyvinyl acetal resin may be used with other known binder resins. The polyvinyl acetal resin of the present invention is preferably contained in a blend in an amount of preferably not less than 50% by weight, and more preferably not less than 70% by weight of the total weight of the resin.

Preferred structural units of the polyvinyl acetal resin useful in the present invention are exemplified below but not limited thereto.

Exemplified resin No.

1.

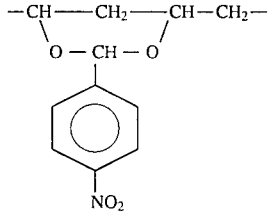

2.

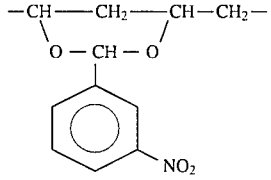

3.

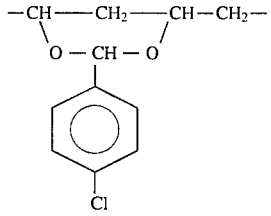

4.

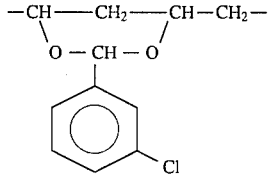

-continued

Exemplified resin No.

5.

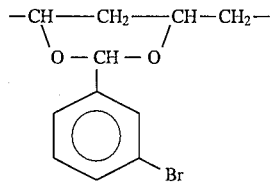

6.

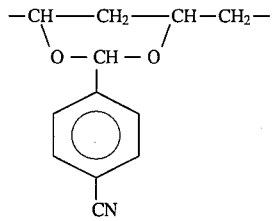

7.

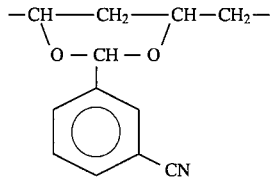

8.

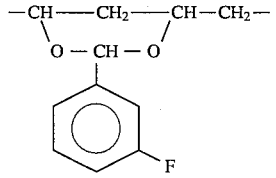

9.

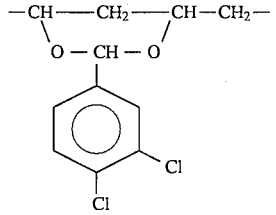

10.

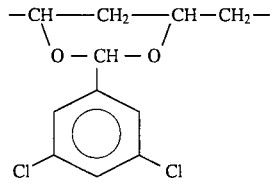

11.

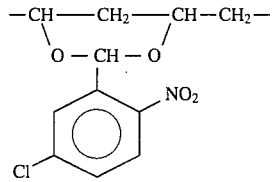

Among the above exemplified resin units, preferred are No. 1, No. 2, No. 3, and No. 4. In particular, the unit No. 2 and unit No. 4 are preferred.

The photosensitive layers in the present invention are classified into two types: (1) the lamination type, which comprises a charge-generating layer containing a charge-generating substance and a charge-transporting layer containing a charge-transporting substance; and (2) single layer type which contains a charge-generating substance and a charge-transporting substance in one layer. Further, the former type is classified into two types according to the lamination order, and preferred is the one in which a charge-generating layer and a charge transporting layer are formed on the supporting member, in that order.

The charge-generating layer may be formed by dissolving a polyvinyl acetal resin in a suitable solvent, adding thereto oxytitanium phthalocyanine as the charge-generating substance, dispersing it by means of a sand mill, roll mill, or the like, applying the dispersion on a supporting member, and drying it. In the charge-generating layer, the ratio of the polyvinyl acetal resin to the oxytitanium phthalocyanine of the present invention is preferably in the range of from 1:10 to 5:1, and more preferably from 1:6 to 2:1. If the ratio of the polyvinyl acetal resin to oxytitanium phthalocyanine is less than 1:10, then the effect of the present invention will be not sufficiently exerted, while, if the amount of the proportion of polyvinyl acetal resin is more than 5:1, than the inherent charge-generation function cannot always be obtained. The thickness of the charge-generating layer is preferably not more than 5 μm, and more preferably is in the range of from 0.05 to 1 μm.

The charge-transporting layer may be formed by dissolving a charge-transporting substance and a binder resin in a suitable solvent, and then by applying and drying the solution on a support. The charge-transporting substance includes triarylamines, hydrazones, stilbenes, pyrazolines, oxazoles, thiazoles, triarylmethanes, and the like. The binder resin includes polyester resins, acrylic resins, polyvinylcarbazole resins, phenoxy resins, polycarbonate resins, polyvinyl butyral resins, polystyrene resins, polyvinyl acetate resins, polysulfone resins, polyarylate resins, vinylidene chloride-acrylonitrile copolymer resins, and the like. The thickness of the charge-transporting layer is preferably in the range of from 5 to 40 μm, and more preferably from 15 to 30 μm.

The single layer type of photosensitive layer may be prepared by dispersing or dissolving oxytitanium phthalocyanine, a charge-transporting substance aforementioned, and at least a polyvinyl acetal resin of the present invention in a suitable solvent, and applying and drying the resulting liquid on a support. The thickness of the photosensitive layer is preferably in the range of from 5 to 40 μm, and more preferably from 15 to 30 μm.

The electroconductive support may be made of a metal such as aluminum, aluminum alloy, copper, zinc, stainless steel, vanadium, molybdenum, chromium, titanium, nickel, indium, gold, or platinum. Alternatively, the support may be: a plastic coated with a metal or alloy mentioned above by vapor deposition (suitable plastic includes polyethylene, polypropylene, polyvinyl chloride, polyethylene terephthalate, acrylic resin, etc.): a plastic, metal, or alloy substrate coated with an electroconductive particulate material (e.g., carbon black, particulate silver, etc.) dispersed in a binder resin; or a plastic or paper impregnated with an electroconductive particulate material.

The support may be in a drum shape, a sheet suitable shape, a belt shape, or in any other shape. The shape of the support is selected to be most suitable for the electrophotographic apparatus employed.

A subbing layer which serves as a barrier and adhesive may be provided between the electroconductive support and the photosensitive layer in the present invention. The subbing layer may be made from a material such as casein, polyvinyl alcohol, nitrocellulose, polyamides (nylon 6, nylon 66, nylon 610, copolymer nylon, alkoxymethylated nylon, etc.), polyurethane, aluminum oxide, and the like. The thickness thereof is preferably not more than 5 μm, and more preferably is from 0.1 to 3 μm.

Further in the present invention, as a protection layer, a simple resin layer or a resin layer containing electroconductive particles or a charge-transporting substance may be provided on the photosensitive layer in order to protect the photosensitive layer from adverse mechanical and chemical influences from outside.

The electrophotographic photosensitive member of the present invention is useful not only for electrophotographic copying machines but also is useful in a wide range of electrophotography application fields such as facsimile machines, laser beam printers, CRT printers, LED printers, liquid crystal printers, and laser beam engraving.

FIG. 1 schematically illustrates an example of the constitution of an electrophotographic apparatus employing the electrophotographic photosensitive member of the present invention.

In FIG. 1, a drum type photosensitive member 1 of the present invention is driven to rotate around the axis la in the arrow direction at a prescribed peripheral speed. The photosensitive member 1 is uniformly charged positively or negatively at the peripheral face during the rotation by an electrostatic charging means 2, and then exposed to an image-exposure light L (e.g. slit exposure, laser beam-scanning exposure, etc.) at the exposure part 3 with an image-exposure means (not shown in the drawing), whereby electrostatic latent images are sequentially formed on the peripheral surface in accordance with the exposed image.

The electrostatic latent image is developed with a toner by a developing means 4. The toner-developed images are sequentially transferred by a transfer means 5 onto a surface of a transfer-receiving material P which is fed between the photosensitive member 1 and the transfer means 5 synchronously with the rotation of the photosensitive member 1 from a transfer-receiving material feeder not shown in the drawing.

The transfer-receiving material P having received the transferred image is separated from the photosensitive member surface, and introduced to an image fixing means 8 for fixation of the image and sent out of the copying machine as a duplicate copy.

The surface of the photosensitive member 1, after the image transfer, is cleaned with a cleaning means 6 to remove any remaining un-transferred toner, and is treated for charge elimination with a pre-exposure means 7 for repeated use for image formation.

The generally employed charging means 2 for uniform charging of the photosensitive member 1 is a corona charging apparatus. The generally employed transfer means 5 is also a corona charging means. In the electrophotographic apparatus, two or more of the constitutional elements of the above described photosensitive member, the developing means, the cleaning means, etc. may be integrated into one device unit, which may be made detachable from the main body of the apparatus. For example, at least one of the charging means, the developing means, and the cleaning means may be combined with the photosensitive member 1 into one device unit which is detachable from the main body of the apparatus by aid of a guiding means such as a rail set in the main body of the apparatus. An electrostatic charging means and/or a developing means may be combined with the aforementioned device unit.

When the electrophotographic apparatus is used as a copying machine or a printer, the optical image exposure light L may be projected onto the photosensitive member as reflected light or transmitted light from an original copy, or otherwise the information read out by a sensor from an original may be signalized, and light is projected, onto a photosensitive member, by scanning with a laser beam, driving an LED array, or driving a liquid crystal shutter array according to the signal.

Figure 2:
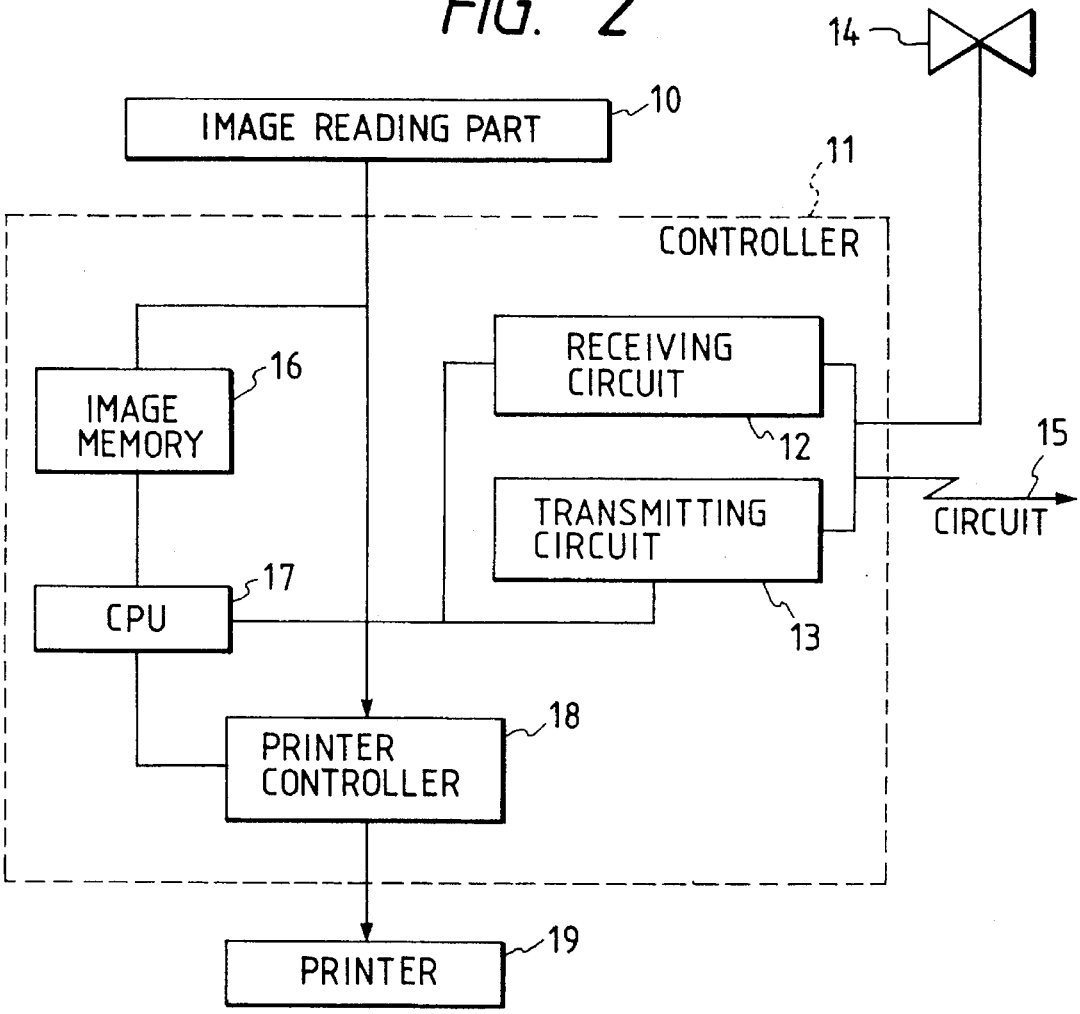
FIG. 2 shows an example of a block diagram of a facsimile system employing an electrophotographic photosensitive member of the present invention.

When the electrophotographic apparatus is used as a printer of a facsimile machine, the optical image exposure light L is employed for printing the received data. FIG. 2 is a block diagram of an example of this case.

A controller 11 controls the image-reading part 10 and a printer 19. The entire operation of the controller 11 is controlled by a CPU 17. Readout data from the image reading part 10 is transmitted through a transmitting circuit 13 to another communication station. Data received from another communication station is transmitted through a receiving circuit 12 to a printer 19. The image data is stored in image memory 16. A printer controller 18 controls a printer 19. The numeral 14 denotes a telephone set.

The image received through a circuit 15, namely image information from a remote terminal connected through the circuit, is demodulated by the receiving circuit 12, treated for compounding of the image information in CPU 17, and successively stored in the image memory 16. When at least one page of image information has been stored in the image memory 16, the images are recorded in such a manner that the CPU 17 reads out the one page of image information, and sends out the compounded one page of information to the printer controller 18, which controls the printer 19 on receiving the one page of information from CPU 17 to record the image information.

During recording by the printer 19, the CPU 17 receives a subsequent page of information.

Images are received and recorded in the manner as described above.

The present invention is described in more detail by reference to Synthesis Examples of oxytitanium phthalocyanine and polyvinyl acetal resins, and Examples of use thereof. In the Examples the term "parts" is based on weight.

Synthesis Example 1

(Synthesis of Oxytitanium Phthalocyanine)

In 100 g of α-chloronaphthalene, 5.0 g of o-phthalodinitrile and 2.0 g of titanium tetrachloride were mixed, and heated and stirred at 200° C. for 3 hours. Then the mixture was cooled to 50° C. The deposited crystals were collected by filtration to obtain pasty dichlorotitanium phthalocyanine. This paste was washed by agitation in 100 ml of N,N'-dimethylformamide at 100° C. Further the paste was washed twice with methanol at 60° C., and collected by filtration. The paste was further agitated in 100 ml of deionized water at 80° C. for one hour, and collected again by filtration to obtain 4.3 g of crystalline oxytitanium phthalocyanine in blue color. The results of the elemental analysis of the resulting compound were as follows.

| | Elemental analysis ($C_{32}H_{16}N_8TiO$) | | | |
|---|---|---|---|---|
| | C | H | N | Cl |
| Calculated (%) | 66.68 | 2.80 | 19.44 | 0.00 |
| Found (%) | 66.50 | 2.99 | 19.42 | 0.47 |

The crystalline matter was dissolved in 30 ml of concentrated sulfuric acid, and the solution was added dropwise into 300 ml of deionized water at 20° C. with stirring to obtain a deposit, which was collected by filtration and sufficiently washed with water to obtain amorphous oxytitanium phthalocyanine. The resulting amorphous oxytitanium phthalocyanine (4.0 g) was stirred and suspended in 100 ml of methanol at room temperature (22° C.) for 8 hours. The suspended matter was collected by filtration and was dried under reduced pressure to give low-crystalline oxytitanium phthalocyanine. Two grams of this oxytitanium phthalocyanine was subjected to milling treatment with 40 ml of n-butyl ether using glass beads of 1 mm diameter at room temperature 22° C. for 20 hours.

The solid matter was separated from the dispersion, and was washed sufficiently with methanol and subsequently with water, and dried to obtain novel crystalline oxytitanium phthalocyanine of the present invention. The yield was 1.8 g. This oxytitanium phthalocyanine exhibited strong peaks at Bragg angles (2θ±0.2°) of 9.0°, 14.2°, 23.9°, and 27.1° in CuKα X-ray diffraction characteristics.

Synthesis Example 2

(Synthesis of Oxytitanium Phthalocyanine)

Oxytitanium phthalocyanine of so-called α type was prepared according to Synthesis Example disclosed in JP-A-61-239248 (U.S. Pat. No. 4,728,592).

Synthesis Example 3

(Synthesis of Oxytitanium Phthalocyanine)

Amorphous oxytitanium phthalocyanine was prepared in the same manner as in Synthesis Example 1. 10 parts of the amorphous oxytitanium phthalocyanine thus prepared was mixed with 15 parts of sodium chloride and 7 parts of diethyleneglycol, and the mixture was subjected to milling treatment by means of an automatic mortar at 80° C. for 60 hours. The treated matter was washed with sufficient water to completely remove sodium chloride and diethyleneglycol contained therein, and was dried under reduced pressure. The dried matter was treated with 200 parts of cyclohexanone with a sand mill using glass beads of 1 mm diameter for 30 minutes. Thus crystalline oxytitanium phthalocyanine was obtained. This crystalline oxytitanium phthalocyanine exhibited strong peaks at Bragg angles (2θ±0.2°) of 9.5°, 9.7°, 11.7°, 15.0°, 23.5°, 24.1°, and 27.3° in CuKα X-ray diffraction characteristics.

Synthesis Example 4

(Synthesis of Resin No. 2)

In a 3-liter three-necked flask, 250 g of methanol and 250 g of benzene were placed. Thereto were added, with stirring, 50 g of polyvinyl alcohol (polymerization degree: 500, saponification degree 98.5 ±0.5 mol% Kuraray Co., Ltd.) and 750 g of m-nitrobenzaldehyde, and then 5 g of concentrated hydrochloric acid dropwise. The mixture was stirred at a temperature from 55° C. to 60° C. for 40 hours to cause reaction. The reaction mixture was then poured into 10 liters of methanol containing 4 g of sodium hydroxide dissolved therein. The deposited resin was collected by filtration and washed with water. The resin was dissolved in 2 liters of a mixed solvent of acetone and benzene (1:1), and the resulting solution was added dropwise into 18 liters of methanol. The reprecipitated and purified resin was collected by filtration and dried under reduced pressure. The yield of the resin was 83 g.

The acetalization degree of this resin was 66% as measured according to JIS K6728 (Method for Testing Polyvinyl Butyral).

Other polyvinyl butyral resins used in the present invention can be synthesized in a similar manner as above.

EXAMPLE 1

A paint for forming an electroconductive layer was prepared by dispersing 50 parts of titanium oxide powder coated with tin oxide containing 10% of antimony oxide, and 25 parts of resol type phenol resin were dispersed in a mixture of 20 parts of methylcellosolve, 5 parts of methanol, and 0.002 parts of silicone oil (polydimethylsiloxane-polyoxyalkylene copolymer, having weight-average molecular weight of 3000) for 2 hours with a sand mill using glass beads of 1 mm diameter.

The above paint was applied on an aluminum cylinder (30 mm diameter and 260 mm long) by dip coating, and dried at 140° C. for 30 minutes to form an electroconductive layer of 20 μm thick.

Thereon, a solution of 5 parts of a 6-66-610-12 quaternary polyamide copolymer resin (weight-average molecular weight: 29,000) in a mixed solvent of 70 parts of methanol and 25 parts of butanol was applied by dip coating, and dried to form a subbing layer of 1 μm thick.

Separately, 4 parts of the crystalline oxytitanium phthalocyanine derived in Synthesis Example 1 of the present invention, and 2 parts of the polyvinyl acetal resin derived in Synthesis Example 4 of the present invention were dispersed in 100 parts of cyclohexanone for 2 hours by means of a sand mill by use of glass beads of 1 mm diameter. The resulting dispersion was diluted with 100 parts of methyl ethyl ketone.

The resulting diluted dispersion was applied on the aforementioned subbing layer, and was dried at 80° C. for 10 minutes to form a charge-generating layer of 0.15 μm thick.

10 parts of the charge-transporting substance represented by the structural formula below:

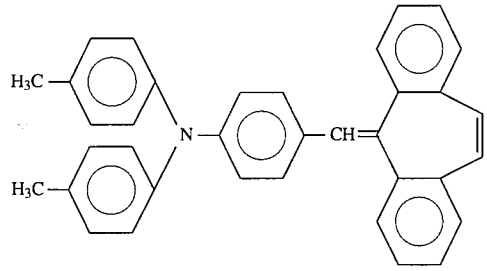

and 10 parts of bisphenol Z type polycarbonate resin (Weight-average molecular weight: 25,000) were dissolved in 60 parts of monochlorobenzene. This solution was applied by dip coating onto the charge-generating layer prepared above, and dried at 110° C. for one hour to form a charge-transporting layer of 20 μm thick.

The obtained photosensitive member was mounted on a laser beam printer (trade name: LBP-SX, made by Canon K.K.). The electrification conditions were set to give a dark area potential of −700 V. The sensitivity of the photosensitive member was determined by measuring the quantity of laser light of 802 nm required to decrease the potential from −700 V to −150 V. The residual potential was determined by measuring the potential after irradiation of light of 10 $\mu J/cm^2$. Further 2000 sheets of blank charging durability test was conducted with the quantity of light to decrease surface potential of the photosensitive member to −150 V, and the potential was measured after the test of 2000 sheets.

The laser beam of the printer employed gave a Spot of 85 μm in diameter in the main scanning direction and 100 μm in diameter in the auxiliary scanning direction. The processing speed was 47 mm/sec.

The results are shown in Table 1.

Comparative Example 1

A photosensitive member was prepared and evaluated in the same manner as in Example 1 except that a commercial polyvinyl butyral resin (trade name: BM-2, Sekisui Chemical Co., Ltd.) was used as the polyvinyl acetal resin.

TABLE 1

| Photosensitive member | Sensitivity ($\mu J/cm^2$) | Residual potential (V) | Potential after 2000-sheet test (V) |
|---|---|---|---|
| Example 1 | 0.35 | −40 | −150 |
| Comparative Example 1 | 0.38 | −90 | −190 |

EXAMPLE 2

A photosensitive member was prepared and evaluated in the same manner as in Example 1 except that the polyvinyl acetal resin was synthesized using p-chlorobenzaldehyde in place of m-nitrobenzaldehyde of Synthesis Example 4. The results are shown in Table 2.

EXAMPLE 3

A photosensitive member was prepared and evaluated in the same manner as in Example 1 except that the polyvinyl acetal resin was synthesized by use of m-cyanobenzaldehyde in place of m-nitrobenzaldehyde of Synthesis Example 4. The results are shown in Table 2.

EXAMPLE 4

A photosensitive member was prepared and evaluated in the same manner as in Example 1 except that the oxytitanium phthalocyanine used was the one prepared in Synthesis Example 2. The results are shown in Table 2.

EXAMPLE 5

A photosensitive member was prepared and evaluated in the same manner as in Example 1 except that the oxytitanium phthalocyanine used was the one prepared in Synthesis Example 3. The results are shown in Table 2.

TABLE 2

| Photosensitive member | Sensitivity ($\mu J/cm^2$) | Residual potential (V) | Potential after 2000-sheet test (V) |
|---|---|---|---|
| Example 2 | 0.34 | −35 | −155 |
| Example 3 | 0.35 | −40 | −150 |
| Example 4 | 0.95 | −30 | −155 |
| Example 5 | 0.44 | −25 | −160 |

EXAMPLE 6

A photosensitive member was prepared in the same manner as in Example 1 except that the aluminum cylinder was 80 mm in diameter and 36 mm in length.

The obtained photosensitive member was mounted on a digital color copying machine (trade name: CLC-500, Canon K.K.). The electrification conditions were set so as to give a dark-area potential of −700 V. The sensitivity of the photosensitive member was determined by measuring the quantity of laser light of 790 nm required to decrease the potential from −700 V to −200 V. The residual potential was determined by measuring the potential after light irradiation of 10 $\mu J/cm^2$.

The laser beam of the copying machine employed gave a spot of 40 μm in diameter in the main scanning direction and 60 μm in diameter in the auxiliary scanning direction. The process speed was 160 mm/sec.

The results are shown in Table 3.

Comparative Example 2

A photosensitive member was prepared in the same manner as in Comparative Example 1 except that the aluminum cylinder was 80 mm in diameter and 360 mm in length. The obtained photosensitive member was evaluated in the same manner as in Example 6. The results are shown in Table 3.

TABLE 3

| Photosensitive member | Sensitivity ($\mu J/cm^2$) | Residual potential (V) |
|---|---|---|
| Example 6 | 0.6 | −50 |
| Comparative Example 2 | 1.5 | −130 |

EXAMPLE 7

A paint for a protecting layer was prepared by dispersing 1 part of powdery polytetrafluoroethylene (trade name: Lubron L-2, made by Daikin Industries, Ltd.) in a solution of 3 parts of bisphenol Z type polycarbonate resin (weight-average molecular weight: 30,000) in monochlorobenzene and adding thereto 2 parts of the charge-transporting substance used in Example 1. This paint was applied on a photosensitive member prepared in the same manner as in Example 1 by spraying, and was dried to prepare a protection layer of 2 μm thick. The resulting photosensitive member was evaluated in the same manner as in Example 1.

The results are shown in Table 4.

Comparative Example 3

A protection layer was formed in the same manner as in Example 7 on a photosensitive member prepared in the same manner as in Comparative Example 1. The resulting photosensitive member was evaluated in the same manner as in Example 1.

The results are shown in Table 4.

TABLE 4

| Photosensitive member | Sensitivity ($\mu J/cm^2$) | Residual potential (V) | Potential after 2000-sheet test (V) |
|---|---|---|---|
| Example 7 | 0.36 | −45 | −160 |
| Comparative Example 3 | 0.51 | −120 | −200 |

Comparative Examples 4 and 5

A photosensitive member was prepared in the same manner as in Example 1 except that a polyester resin (trade name: Bairon 200, made by Toyobo Co., Ltd.) was used in place of the polyvinyl acetal resin.

As Comparative Examples 4 and 5, the resulting photosensitive member was evaluated in the same manner as in Example 1 and Example 6 respectively. The results are shown in Table 5.

TABLE 5

| Photosensitive member | Sensitivity (μJ/cm²) | Residual potential (V) | Potential after 2000-sheet test (V) |
|---|---|---|---|
| Comparative Example 4 | 0.39 | −100 | −200 |
| Comparative Example 5 | 1.6 | −150 | — |

What is claimed is:

1. An electrophotographic photosensitive member comprising an electroconductive support, and a photosensitive layer formed thereon, the photosensitive layer containing oxytitanium phthalocyanine and a polyvinyl acetal resin having a structural unit represented by Formula (1) below:

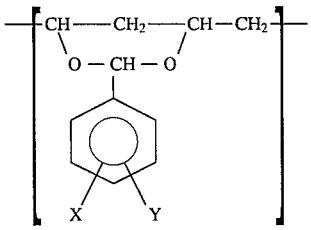

(1)

wherein X is a hydrogen atom, a fluorine atom, a chlorine atom, a bromine atom, a nitro group, or a cyano group; and Y is a fluorine atom, a chlorine atom, a bromine atom, a nitro group, or a cyano group.

2. An electrophotographic photosensitive member according to claim 1, wherein the oxytitanium phthalocyanine is in a crystal form exhibiting strong peaks at Bragg angles (2θ±0.2°) of 9.0°, 14.2°, 23.9°, and 27.1° in CuKα X-ray diffraction characteristics.

3. An electrophotographic photosensitive member according to claim 1, wherein the acetalization degree of the polyvinyl acetal resin is not less than 50 mol%.

4. An electrophotographic photosensitive member according to claim 3, wherein the acetalization degree of the polyvinyl acetal resin is from 65 to 85 mol%.

5. An electrophotographic photosensitive member according to claim 1, wherein the structural unit represented by Formula (1) is selected from the group of units represented by the formulas:

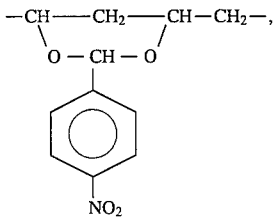

-continued

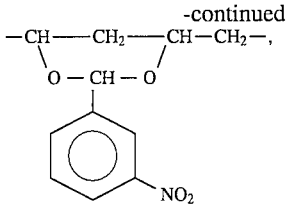

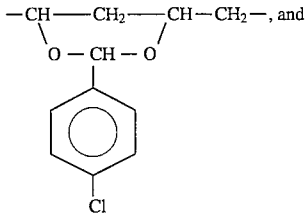

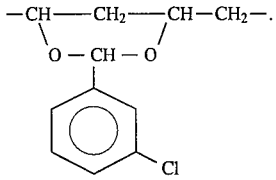

6. An electrophotographic photosensitive member according to claim 5, wherein the structural unit represented by Formula (1) is selected from the group of units represented by the formulas:

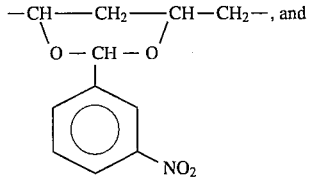

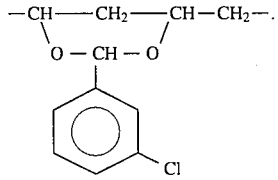

7. An electrophotographic photosensitive member according to claim 1, wherein the photosensitive layer comprises a charge-generating layer and a charge-transporting layer.

8. An electrophotographic photosensitive member according to claim 7, wherein the charge-generating layer contains oxytitanium phthalocyanine and a polyvinyl acetal resin having the structural units represented by Formula (1).

9. An electrophotographic photosensitive member according to claim 1, wherein the photosensitive layer is of a single layer structure.

10. An electrophotographic photosensitive member according to claim 1, wherein the electrophotographic photosensitive member has a subbing layer between the electroconductive support and the photosensitive layer.

11. An electrophotographic photosensitive member according to claim 1, wherein the electrophotographic photosensitive member has a protection layer on the photosensitive layer.

12. An electrophotographic apparatus, comprising an electrophotographic photosensitive member, an image-forming means for forming an electrostatic latent image, a developing means for developing the formed latent image, and a transferring means for transferring a developed image to an image-receiving material;

said electrophotographic photosensitive member comprising an electroconductive support, and a photosensitive layer formed thereon, the photosensitive layer containing oxytitanium phthalocyanine and a polyvinyl acetal resin having a structural unit represented by Formula (1) below:

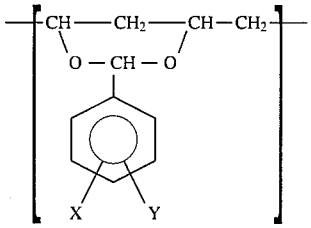

(1)

wherein X is a hydrogen atom, a fluorine atom, a chlorine atom, a bromine atom, a nitro group, or a cyano group; and Y is a fluorine atom, a chlorine atom, a bromine atom, a nitro group, or a cyano group.

13. A device unit, comprising an electrophotographic photosensitive member, and at least one means selected from the group of a charging means, a developing means, and a cleaning means; said electrophotographic photosensitive member comprising an electroconductive support, and a photosensitive layer formed thereon, the photosensitive layer containing oxytitanium phthalocyanine and a polyvinyl acetal resin having a structural unit represented by Formula (1) below:

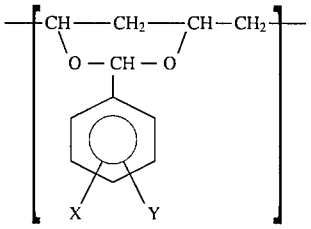

(1)

wherein X is a hydrogen atom, a fluorine atom, a chlorine atom, a bromine atom, a nitro group, or a cyano group; and Y is a fluorine atom, a chlorine atom, a bromine atom, a nitro group, or a cyano group; said device unit holding integrally the electrophotographic photosensitive member and at least one of the charging means, a developing means, and the cleaning means, and being detachable from the main body of an electrophotographic apparatus.

14. A facsimile machine comprising an electrophotographic apparatus and an information-receiving means for receiving image information from a remote terminal;

said electrophotographic apparatus comprising an electrophotographic photosensitive member; and said electrophotographic photosensitive member comprising an electroconductive support, and a photosensitive layer formed thereon, the photosensitive layer containing oxytitanium phthalocyanine and a polyvinyl acetal resin having a structural unit represented by Formula (1) below:

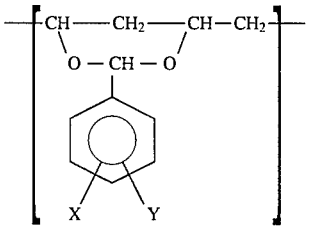

(1)

wherein X is a hydrogen atom, a fluorine atom, a chlorine atom, a bromine atom, a nitro group, or a cyano group; and Y is a fluorine atom, a chlorine atom, a bromine atom, a nitro group, or a cyano group.

* * * * *